US006019629A

United States Patent [19]

Ito et al.

[11] Patent Number: 6,019,629

[45] Date of Patent: Feb. 1, 2000

[54] CONNECTOR

[75] Inventors: Hikaru Ito; Satoru Nishide, both of Yokkaichi, Japan

[73] Assignee: Sumitomo Wiring Systems, Ltd., Japan

[21] Appl. No.: 08/966,150

[22] Filed: Nov. 7, 1997

[30] Foreign Application Priority Data

Nov. 8, 1996 [JP] Japan ..... 8-296640

[51] Int. Cl.[7] ..... H01R 3/00

[52] U.S. Cl. ..... 439/489; 439/352; 439/354

[58] Field of Search ..... 439/489, 352, 439/354, 347

[56] References Cited

U.S. PATENT DOCUMENTS

| | | | |
|---|---|---|---|
| 4,915,648 | 4/1990 | Takase et al. | 439/353 |
| 4,993,967 | 2/1991 | Matsumoto | 439/352 |
| 5,791,930 | 8/1998 | Tabata et al. | 439/352 |

FOREIGN PATENT DOCUMENTS

| | | |
|---|---|---|
| 296640 | 8/1996 | Japan . |
| 955261 | 2/1997 | Japan . |

*Primary Examiner*—Hien Vu
*Attorney, Agent, or Firm*—Anthony J. Casella; Gerald E. Hespos

[57] ABSTRACT

An easily produced connector is provided with a partial engagement preventing function. A movable member 30 movably provided in a male connector housing along an engagement direction is biased by coil springs 40 toward a front end position with respect to the engagement direction. When the engagement is stopped when connector housings 10, 20 are partly engaged, the connector housings 10, 20 are separated away from each other by the forces of the coil springs 40, thereby informing an operator that the connector housings 10, 20 were partly engaged. The movable member 30 is formed with an engaging hole 31 which extends in a direction normal to its moving direction and is engageable with a lock arm 12 provided on the female connector housing 10. By providing an engaging portion with the lock arm 12 in the movable member 30, the connector housing can have a simpler construction and can be easily produced unlike a prior art male connector housing which has a complicated construction because the engaging portion is provided therein.

7 Claims, 5 Drawing Sheets

CONNECTOR

BACKGROUND OF THE INVENTION

1. Field of the Invention

The present invention relates to a connector provided with a partial engagement preventing function.

2. Description of the Prior Art

Conventionally, there has been known a connector which uses a lock arm to prevent a partial engagement. Specifically, an elastically deformable lock arm is provided on one connector housing, and a movable member which is biased by a spring member so as to move forward with respect to an engagement direction is provided right above an entering path of the lock arm in the other connector housing. Upon the engagement of both housings, an engaging portion provided on the lock arm moves onto a locking portion provided in the entering path, thereby being elastically deformed to face the movable member. The two housings are being engaged while the movable member is pressed against a biasing force. When the housings are properly engaged, the engaging portion of the lock arm moves beyond the locking portion and the lock arm is returned to its original position, with the result that the housings are locked by the engagement of the engaging portion with the rear surface of the locking portion and the movable member is returned to its original position. On the other hand, if the engagement is interrupted at a stage where the housings are partly engaged, the housings are pushed back by the biasing force of the spring member, so that the partial engagement can be easily discriminated.

In the aforementioned prior art connector, the connector housings are locked in their properly engaged states by the engagement of the engaging portion of the lock arm and the locking portion of the mating connector housing. Since the locking portion is formed in the entering path in the mating connector housing, the construction within the entering path becomes complicated, disadvantageously leading to an increased production cost for a mold molding the connector housing.

The present invention was developed in view of the above problem and an object thereof is to provide a connector housing provided with a partial engagement preventing function which has a simple construction.

SUMMARY OF THE INVENTION

According to the invention, there is provided a connector, comprising at least a pair of connector housings that are engageable with each other. One connector housing comprises a lock arm. The other connector housing comprises a movable member which is movable along an engagement direction of the connector housings. A spring or other biasing means is provided for biasing the movable member to a first position, preferably forward with respect to the engagement direction. The lock arm moves or urges or can move the movable member toward a second position, preferably backwardly, by pushing it against the biasing means, preferably up to a state substantially immediately before the connector housings are properly engaged. At least one of facing portions of the lock arm and the movable member is formed with a guide portion for guiding the lock arm to a position where it is retracted substantially outside a movable area of the movable member when the connector housings are substantially properly engaged. The movable member is formed with a mating locking means lockingly engaging the lock arm when the movable member is positioned or returned to its original or first position.

According to a preferred embodiment of the invention, the lock arm is elastically deformable and preferably is formed unitarily or integrally with the one connector housing.

Preferably, the mating locking means comprises a locking recess which permits the lock arm to be returned to its original position when the movable member is returned to its original or first position, preferably by a biasing force of the biasing means as the lock arm is retracted.

Further preferably, at least one of the connector housings, is provided with a position holder means for restricting the lock arm substantially to its undeflected position where the lock arm moves the movable member backwardly by pushing it preferably against the biasing means, up to the state substantially immediately before the connector housings are engaged properly.

Still further preferably, the guide portion is an inclined portion having such an inclination that, when the connector housings are or are to be substantially properly engaged, the lock arm is moved toward a position at a distance or radial distance from the guide portion, such that the movable member is preferably disengaged from the lock arm (being preferably displaced or deformed) and can be moved by the biasing means toward its first position.

Most preferably, the movement of the movable member is limited at least in one direction by movement range limiting means provided on at least one of the movable member and the other connector housing.

According to a further preferred embodiment of the invention, there is provided a connector, comprising a pair of connector housings that are engageable with each other. One connector housing comprises an elastically deformable lock arm. The other connector housing comprises a movable member which is movable along an engagement direction of the connector housings. A spring means is provided for biasing the movable member forwardly with respect to the engagement direction. The lock arm moves the movable member backwardly by pushing it against the spring means up to a state immediately before the connector housings are properly engaged. At least one of facing portions of the lock arm and the movable member is formed with a guide portion for guiding the lock arm to a position where it is retracted outside a movable area of the movable member when the connector housings are properly engaged. The movable member is formed with a locking recess which permits the lock arm to be returned to its original position when the movable member is returned to its original position by a biasing force of the spring means as the lock arm is retracted, and engages the lock arm.

Accordingly, when the connector housing are engaged, the movable member is moved backwardly by being pushed by the lock arm against the spring means. Since the lock arm keeps receiving the biasing force of the spring means via the movable member until the connector housings are properly engaged, the lock arm is guided by the guide portion to such a position as to be retracted outside the movable area of the movable member. When the lock arm is displaced to its retracted position, the movable member is returned to its original position by the spring member. As a result, the lock arm is returned to its original position to engage the locking recess and lock the connector housings.

If the engagement is interrupted before the connector housings are properly engaged, since the biasing force of the spring means is acting in such a direction to return the lock arm to its original position via the movable member, the connector housing does not stay in the position where the engagement is interrupted, but is pushed out. By seeing the pushed out connector housing, an operator can confirm that the connector housings are only partly engaged.

As described above, a portion for locking the lock arm is provided not on the connector housing itself, but on the movable member which is separate from the connector housing. Accordingly, the connector housing itself can be fabricated to have a simple construction and, thus, a mold therefor can be inexpensively produced.

Preferably, the other connector housing is provided with a position holder for restricting the lock arm to its position where the lock arm moves the movable member backwardly by pushing it against the spring means up to the stage immediately before the connector housings are properly engaged.

Accordingly, even if a force which can cause the deformation of the lock arm acts when the connector housings are partly engaged, the downward displacement of the lock arm is prevented. Accordingly, the lock arm is more securely brought into contact with the movable member, thereby realizing a more secure detection of the partial engagement.

These and other objects, features and advantages of the present invention will become more apparent upon a reading of the following detailed description and accompanying drawings.

DETAILED DESCRIPTION OF THE PREFERRED EMBODIMENTS

Figure 1:
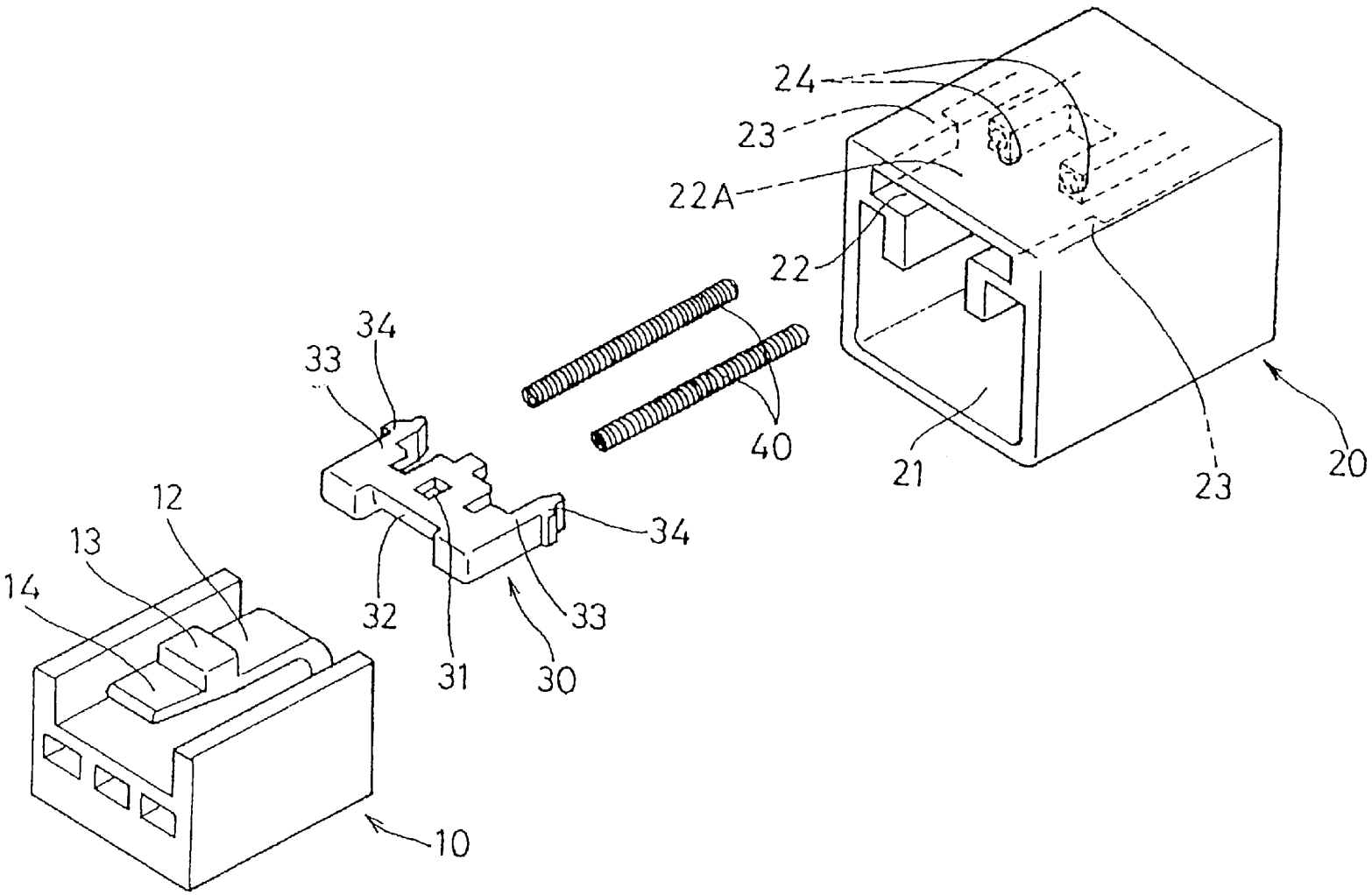
FIG. 1 is an exploded perspective view of a first embodiment of the invention.
Figure 2:
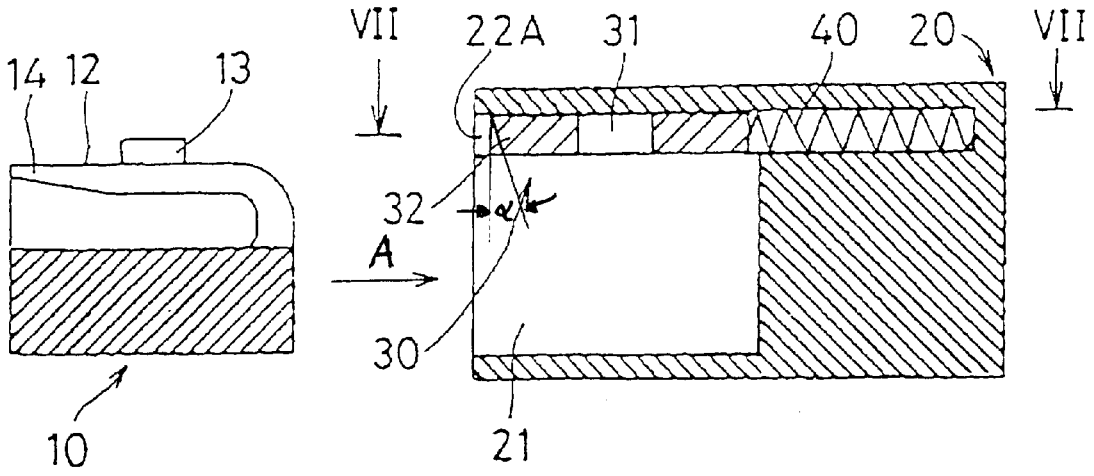
FIG. 2 is a section of the first embodiment in its separated state.
Figure 3:
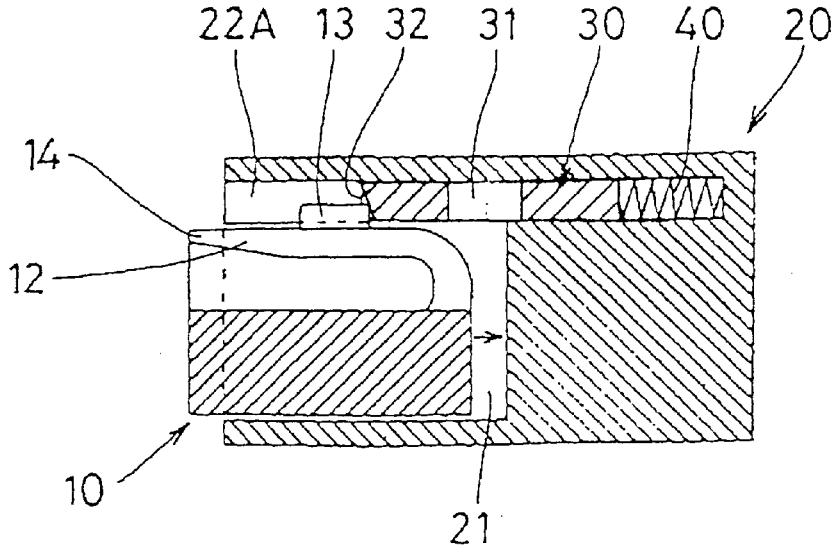
FIG. 3 is a section of the first embodiment in its partly engaged state.

A first embodiment of the present invention is described with reference to FIGS. 1 to 7. A connector according to this embodiment is comprised of a female connector housing 10 in which female terminal fittings are mounted and a male connector housing 20 in which male terminal fittings are mounted, the housings 10 and 20 being engageable with and disengageable from each other. FIGS. 2 to 6 should be referred to concerning directions mentioned below. For each connector housing, terminal fittings and cavities for substantially accommodating them and the like are unillustrated in order to simplify the description.

The female connector housing 10 is integrally or unitarily provided, on its upper surface, with a lock arm 12 for locking the female and male connector housings 10, 20 in their substantially properly engaged states. This lock arm 12 extends substantially upwardly from the front end or front portion of the female connector 10 and then a free end thereof extends substantially backwardly. The lock arm 12 is movable, and preferably is elastically deformable along a direction away from the female housing 10, in particular substantially upward and downward. A lock projection 13 projects on a surface of the lock arm 12 substantially opposite to the female housing 10, and is engageable with or fittable into an engaging hole 31 of a movable member 30 to be described later.

On the other hand, the male connector housing 20 is provided with a receptacle 21 which is open in the front surface thereof and adapted to receive the female connector housing 10. A ceiling space 22 is located substantially above the receptacle 21 and also is open in the front surface. The ceiling space 22, as shown in detail in FIG. 7, serves as a displacement or moving or movable area 22A according to the invention, in which the movable member 30 is or can be substantially movably accommodated in an engagement direction. The movable member 30 is inserted into the movable area 22A from its end or front opening by narrowing the spacing between elastic arms 33 provided on the opposite sides thereof. Locking claws 34 of the arms 33 are engaged with stoppers 23 (forming movement range limiting means) formed on the opposite inner side walls of the movable area 22A so as to prevent the movable member 30 from coming out of the movable area 22A and locate the movable member 30 in a first position or preferably a front end position with respect to a moving direction. The movable member 30 is movable within a specified range behind this first position or front end position. Behind the movable area 22A are provided preferably two rows of spring member receptacles 24. One or more compressed coil springs 40 accommodated in the receptacles 24 bias the movable member 30 toward a position (first position) where the stoppers 23 and the locking claws 34 are engaged.

The movable area 22A communicates with the receptacle 21 preferably in substantially the middle with respect to its widthwise direction (see FIG. 1). The lock arm 12 is accommodated in this communicating portion. The lock projection 13 projects into the movable area 22A (see FIG. 3) when the lock arm 12 is in a natural state and is substantially not deformed. When the lock arm 12 is deformed downwardly, the lock projection 13 is displaced outside the movable area 22 (see FIG. 4). Accordingly, when the female connector housing 10 is inserted into the receptacle 21 with the lock arm 12 in its natural state, the movable member 30 is pushed or moved or urged in a direction of insertion A of the movable member 30 or the female connector housing 10 into the male connector housing 20, in particular backwardly with respect to the engagement direction by the lock projection 13, thereby elastically compressing the coil springs 40 (see a change from FIG. 2 to FIG. 3). If the lock arm 12 is deformed in this state, the lock projection 13 moves out of the movable area 22A, and the movable member 30 is pushed or moved or urged in a direction B opposed to the direction A of insertion, in particular forwardly with respect to the engagement direction by the accumulated reaction of the coil springs 40 (see a change from FIG. 4 to FIG. 5).

At the leading end of the movable member 30 with respect to the engagement direction is formed a receiving portion 32 which is pushed by the lock projection 13. The receiving portion 32 overhangs, i.e. is inclined in a displacement or deflection direction of the lock arm 12, in particular downwardly, so that the elastic forces of the coil springs 40 can be divided into components acting to the left of FIG. 2 which deflect or displace or push the lock projection 13 back and components acting downward of FIG. 2 which deflect or displace or push the lock projection 13 preferably down. The inclination a of the receiving portion 32 is set such that, when the connector housings 10, 20 are properly engaged, the downward acting components of its force can push the lock arm 12 down. When the lock arm 12 is deformed downwardly, as a result of the engagement between the lock projection 13 and the receiving portion 32, only the movable member 30 is pushed backwardly by the coil springs 40, while the connector housings 10, 20 are held in their proper engagement positions, and the movable member 30 is located in the front end position with respect to the engagement direction.

A portion of the movable member 30 which faces the lock projection 13, preferably along the substantially vertical direction in the above positioned state, is formed with an engaging hole 31, which is engaged or engageable with the lock projection 13 to lock the connector housings 10, 20 in their properly engaged states. Further, the lower surface of the movable member 30 is substantially flat, and comes or can come into sliding contact with the lock projection 13 while the movable member 30 is moved, thereby holding the lock arm 12 deformed downwardly.

The rear end of the lock arm 12 is an operable portion 14 where a finger of an operator is put to unlock the connector housings.

Next, the action of this embodiment is described.

When the connector housings 10, 20 are engaged, since the lock projection 13 projecting into the movable area 22A pushes or moves or urges the movable member 30 into the connector housing 20, in particular backwardly, the coil springs 40 are elastically compressed to gradually increase a reaction against the engagement. The elastic forces of the coil springs 40 are divided by the receiving portion 32 into first components along the insertion direction A, preferably the horizontal components, for pushing the female connector housing 10 forward with respect to the engagement direction and second components substantially normal to the first components, preferably the downward acting components, for pushing or deflecting or displacing the lock arm 12 preferably downwardly. However, at an intermediate stage of the engagement, the second or downwardly acting components of force are not large enough to deform the lock arm 12. Accordingly, if the engagement is completed before the connector housings 10, 20 are properly engaged (e.g. a state shown in FIG. 3), the lock arm 12 is relatively pushed out of the receptacle 21 by the horizontal components of the forces of the coil springs 40, thereby considerably separating the connector housings 10, 20. Thus, it is definitely known to the operator that the connector housings 10, 20 were not properly engaged.

Figure 4:
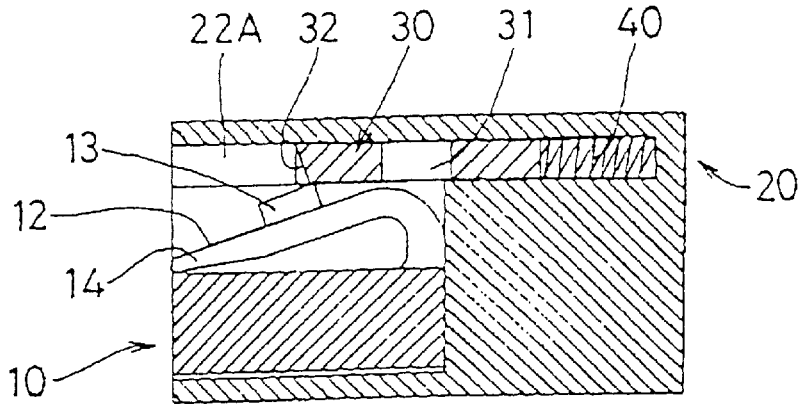
FIG. 4 is a section of the first embodiment when a lock arm is pushed down in a proper engagement position.
Figure 5:
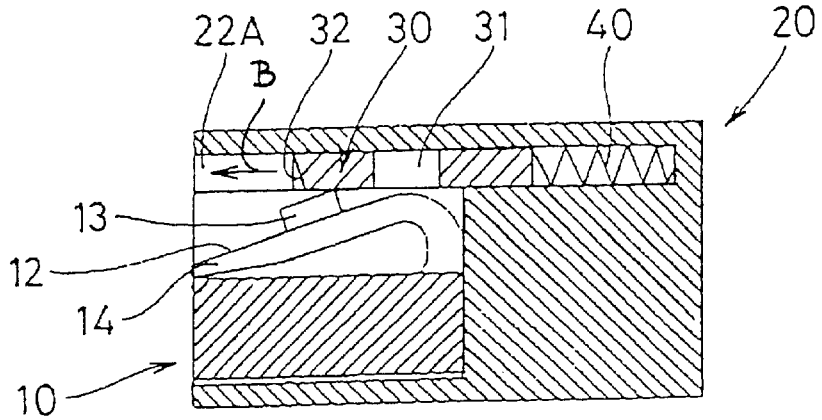
FIG. 5 is a section of the first embodiment when a movable member is moved to a front end position with respect to an engagement direction.
Figure 6:
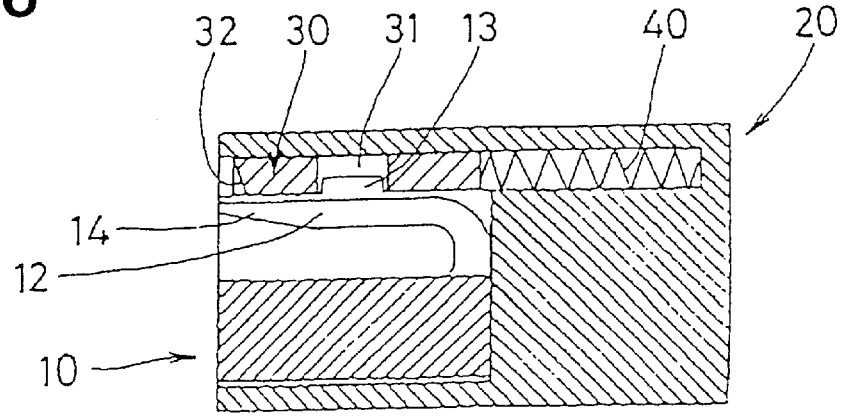
FIG. 6 is a section of the first embodiment when it is locked in its proper engagement position.
Figure 7:
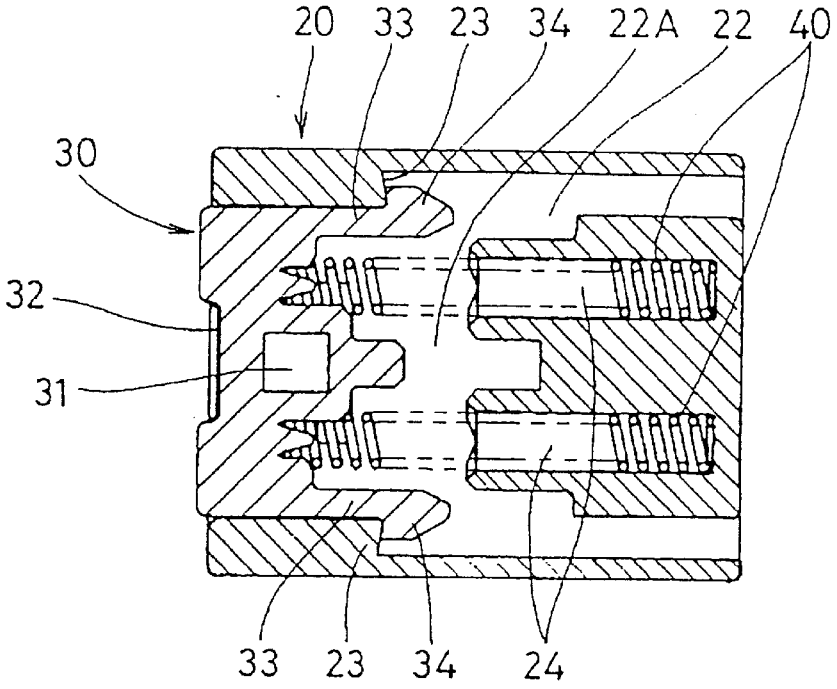
FIG. 7 is a section along VII—VII of FIG. 2.

When the connector housings 10, 20 reach their proper engagement positions, the lock arm 12 is elastically deformed downward by the second or downwardly acting components of force (see FIG. 4). Then, the lock projection 13 of the lock arm 12 is disengaged from the receiving portion 32 of the movable member 30, with the result that the movable member 30 is moved forwardly with respect to the engagement direction by the elastic forces of the coil springs 40. While the movable member 30 is moving, the lock projection 13 is in sliding contact with the lower surface of the movable member 30 and the lock arm 12 is held deformed (see FIG. 5). When the movable member 30 reaches the front end position with respect to the engagement direction, the lock projection 13 substantially faces the engaging hole 31 and the lock arm 12 is returned to its original free state (see FIG. 6). As a result, the lock projection 13 is fitted into the engaging hole 31, thereby locking the connector housings 10, 20 in their properly engaged states.

Since the portion for locking the lock arm 12 (or the engaging hole 31) is formed not in the male connector housing 20 itself, but in the movable member 30 which is separate from the male connector housing 20, the male connector housing 20 can be so fabricated as to have a simple construction and, thus, a mold therefor can be inexpensively produced.

Figure 8:
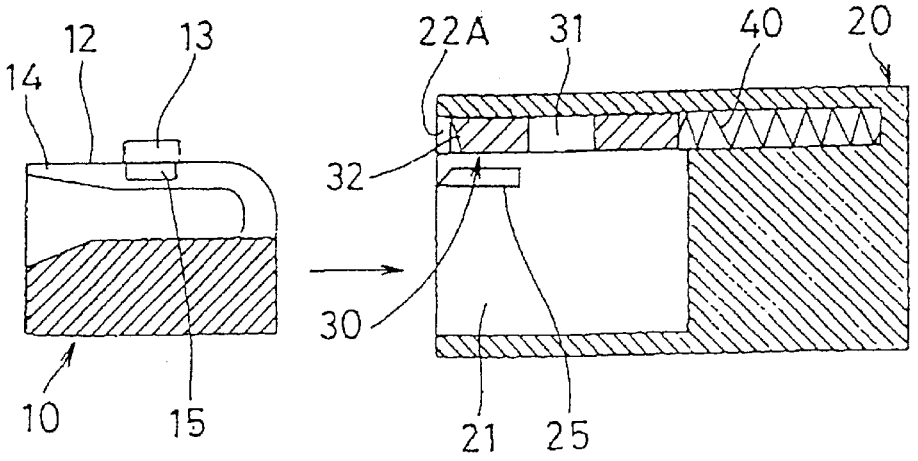
FIG. 8 is a section of a second embodiment of the invention in its separated state.
Figure 9:
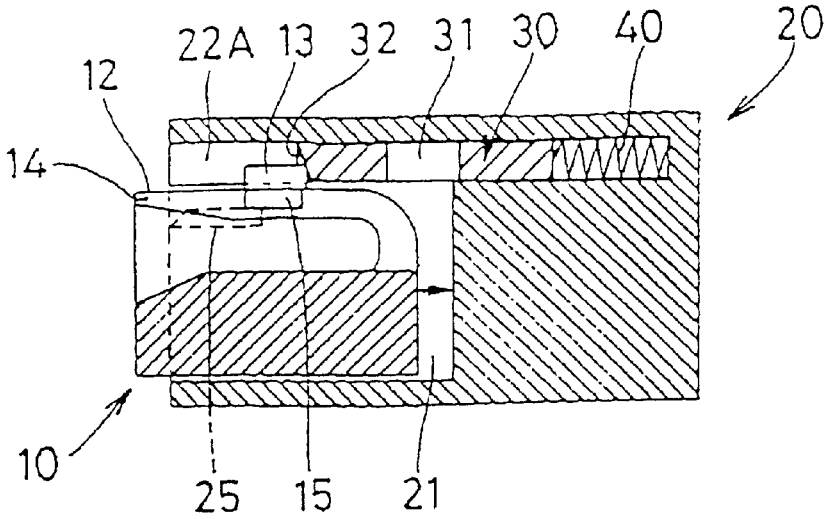
FIG. 9 is a section of the second embodiment in its partly engaged state.
Figure 10:
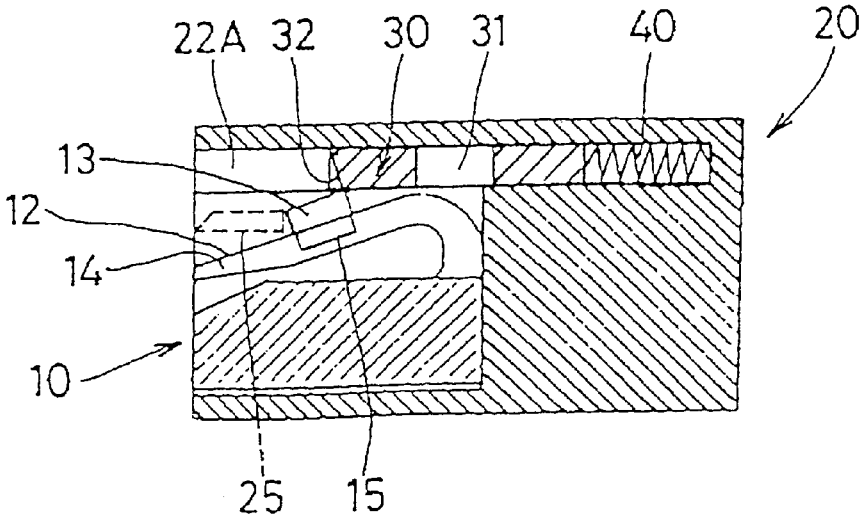
FIG. 10 is a section of the second embodiment when a lock arm is pushed down in a proper engagement position.

Next, a second embodiment of the invention is described with reference to FIGS. 8 to 10. The construction of this embodiment differs from that of the first embodiment in that a position holder means for preventing the deformation or displacement of the lock arm 12 in the partly engaged state is provided between the lock arm 12 and the connector housing. Since the other construction is same or similar as the first embodiment, no description is given to the same construction concerning its construction, action and effects by identifying it by the same reference numerals.

The lock arm 12 is formed with preferably a pair of projections 15 projecting from the opposite side surfaces thereof. The receptacle 21 of the male connector housing 20 is formed with restricting portions 25 which substantially project along a lower limit of a space where the projections 15 enter. As shown in FIG. 9, when the connector housings 10, 20 are partly engaged, the restricting portions 25 at least partly face the projections 15 along a direction substantially normal to the insertion direction, preferably a vertical direction in FIG. 9, preventing the lock arm 12 from being elastically deformed downward in a predetermined or predeterminable range of movement or insertion of the male and/or female connector housing 20/10. As shown in FIG. 10, preferably when the connector housings 10, 20 substantially reach their proper engagement positions, the projections 15 and the position holders 25 do no face each other, permitting the downward deformation of the lock arm 12.

In this embodiment, even if a force which can cause the deformation of the lock arm 12 acts when the connector housings 10, 20 are partly engaged, the downward displacement of the lock arm 12 is prevented. Accordingly, the lock arm 12 is brought more securely into contact with the movable member 30, thereby realizing a more secure detection of the partial engagement.

The present invention is not limited to the described and illustrated embodiments. For example, the following embodiments are embraced by the technical scope of the present invention as defined in the claims. Besides the following embodiments, a variety of changes can be made without departing the spirit and scope of the present invention as defined in the claims.

Although the engaging hole 31 (locking recess according to the invention) is a through hole formed in the movable member 30 and extending along vertical direction, it does not have to be a through hole. In other words, it is sufficient that the engaging hole 31 be engageable with the lock projection 13 in such a manner that the lock projection 13 is not movable backward with respect to the engagement direction. Although the movable member 30 is biased using the compression coil springs 40 as spring members, spring members other than the compression coil springs (e.g. leaf springs) may be used.

Although description is made on the case where the lock arm 12 is provided on the female connector housing 10 in the foregoing embodiments, the present invention is also applicable to connectors in which a lock arm is provided on a male connector housing.

Furthermore the lock arms 12 were described as being unitarily or integrally formed with the connector housing. However the lock arms may be hinged or pivotally supported on the connector housing e.g. by a hinge or swivel axis or joint or the like.

What is claimed is:

1. An electrical connector, comprising:

a first connector housing having a lock arm formed thereon, said lock arm being resiliently deflectable from an original position to a retracted position;

a second connector housing having front and rear ends and defining a receptacle extending into the front end, the second connector housing being configured for enabling said first connector housing to be selectively movable between an unengaged condition, a partly engaged condition and a fully engaged condition relative to the receptacle of the second connector housing without direct locked engagement between the second connector housing and the lock arm of the first connector housing;

at least one spring disposed in the receptacle from the front end of the second connector housing and extending forwardly from a location in proximity to the rear end of the second connector housing;

a movable member movably secured in the receptacle from the front end of the second connector housing for movement between a front position in proximity to the front end of the second connector housing and a rear position further from the front end of the second connector housing, said movable member being biased by the spring toward the front position, the movable member further having a forwardly facing receiving portion engaged against the lock arm when the first connector housing is in the partly engaged condition in the receptacle, said receiving portion of the movable member being configured to deflect the lock arm to the retracted position when the movable member reaches the rear position and when the first connector housing reaches the fully engaged condition, thereby enabling the spring to move the movable member over the lock arm and to the front position of the movable member, said movable member further having a locking recess formed thereon at a location for releasable locked engagement with the lock arm only when the first connector housing is in the fully engaged condition and when the movable member has been moved by the spring to the front position, whereby the locking recess of the movable member releasably locks with the lock arm when the first connector housing reaches the engaged condition and whereby the movable member and the spring cooperate to urge the first connector housing from the receptacle when the first connector housing is in the partly engaged condition.

2. An electrical connector according to claim 1, wherein the lock arm is elastically deformable and integrally formed with the first connector housing.

3. An electrical connector according to claim 1, wherein the second connector housing, is provided with a position holder means for restricting the lock arm substantially to the original position and enabling the lock arm to move the movable member to the rear position by pushing the movable member against the at least one spring, the holder means being disposed for permitting deflection of the lock arm to the retracted position substantially when the first connector housing reaches the properly engaged condition.

4. An electrical connector according to claim 1, wherein the receiving portion is an inclined portion having such an inclination that, when the connector housings are substantially in the properly engaged condition, the lock arm is moved toward a position at a distance from the receiving portion.

5. An electrical connector according to claim 1, wherein movement of the movable member is limited at least in one direction by movement range limiting means provided on at least one of the movable member and the second connector housing.

6. The electrical connector of claim 1, wherein the at least one spring comprises a plurality of springs.

7. The electrical connector of claim 1, wherein the second connector housing and the movable member are provided with cooperating movement range limiting members for preventing said spring from moving said movable member forwardly beyond the front position of the movable member, whereby the cooperating movement range limiting members of the movable member and the second connector housing limit forward movement of the movable member in the receptacle, and whereby the releasable locked engagement of the lock arm of the first connector with the locking recess of the movable member releasably locks the first connector housing in the receptacle of the second connector housing without a direct locked connection between the first and second connector housings.

* * * * *